US005548847A

United States Patent [19]

Spicijaric

[11] Patent Number: 5,548,847

[45] Date of Patent: Aug. 27, 1996

[54] CAP WITH A PICTURE RETAINING POCKET

[76] Inventor: John Spicijaric, 150-11 95th St., Ozone Park, N.Y. 11417

[21] Appl. No.: 352,359

[22] Filed: Dec. 9, 1994

[51] Int. Cl.[6] ..... A42B 1/24

[52] U.S. Cl. ..... 2/209.13; 2/181; 2/195.1; 40/329

[58] Field of Search ..... 2/195.1, 209.13, 2/171, 175.1, 181, 195.2, 195.3, 195.4, 209.3, 209.7; 40/329

[56] References Cited

U.S. PATENT DOCUMENTS

| | | | |
|---|---|---|---|
| 2,803,829 | 8/1957 | Tscharner | 40/329 |
| 4,667,274 | 5/1987 | Daniel | 2/209.13 |
| 5,253,368 | 10/1993 | Blake | 40/329 |
| 5,452,479 | 9/1995 | Mostert | 2/209.13 |
| 5,465,426 | 11/1995 | Beaton | 2/209.13 |

*Primary Examiner*—Diana Biefeld

*Attorney, Agent, or Firm*—Norman E. Lehrer; Jeffrey S. Ginsberg

[57] ABSTRACT

A picture cap for removably retaining a picture or the like and visually displaying the same. The picture cap includes a head covering portion with a window opening formed therein. The cap has an inside and an outside surface. A picture retaining pocket is secured to the inside surface of the head covering portion. The picture retaining pocket has a bottom end, inner and outer walls extending upwardly from the bottom end and an open top end. The bottom end and the walls provide a space therebetween. The outer wall of the pocket extends around the periphery of the window opening and is comprised of transparent material.

6 Claims, 2 Drawing Sheets

CAP WITH A PICTURE RETAINING POCKET

BACKGROUND OF THE INVENTION

The present invention relates generally to headgear, and more particularly, to headgear which includes a picture retaining pocket for visually displaying a picture, photograph or the like inserted therein.

The wearing of hats, by both children and adults alike, has become increasingly prevalent over the years. One very popular type of hat is the baseball cap. The popularity of such caps can be attributed to their relatively low price, their ability to protect the wearer's eyes from sunlight and rain and their availability in numerous styles.

Baseball hats are often adorned with stitched or printed names, logos, pictures, etc. A problem with these hats is that the purchaser cannot modify the message or picture on the hat. If the purchaser wants to obtain a hat with a personalized message, picture or the like, he or she must have such a hat custom made. This can be somewhat expensive. Additionally, since the logo, picture or the like cannot be altered, the hats are often no longer worn or are disposed of if the owner's fondness for the particular message changes.

In recognition of the limitations of existing headgear, various attempts have been made to provide a hat displaying a message, logo or symbol that can be readily changed. For example, U.S. Pat. No. 4,776,043, discloses a hat that has interchangeable patches that can be selectively attached thereto. The patches are attached by hook and loop type fasteners, adhesive or other fastening means. A drawback with this hat and patch system is that the wearer of the hat only has a limited number of patches to chose from. More specifically, the patches are pre-printed or prestitched with the logos or phrases that can be attached to the hat.

U.S. Pat. No. 5,253,368 shows a cap with an erasable writing surface attached to its crown. The wearer of the hat can write any desired message on the writing surface. This patent, however, is not adapted to removably display pictures or photographs. Moreover, this patent requires that an eraser and writing implement be available in order to inscribe the desired message.

U.S. Pat. No. 2,803,829 discloses a cap having a vertically disposed band extending around the periphery thereof. The vertically disposed band has several photograph retaining pockets. The band is not adapted to retain more than one picture at a time. Additionally, the slots for receiving the photographs are located on the exterior of the band instead of being hidden on the inside surface of the cap.

SUMMARY OF THE INVENTION

The present invention is designed to overcome the deficiencies of the prior art discussed above. It is an object of the invention to provide a cap which can visually display pictures or the like.

It is a further object to provide such a hat which allows the wearer to readily remove or change the picture or photograph retained in the hat.

It is yet another object of the invention to provide a hat that has the general appearance of a conventional baseball cap.

A still further object is to provide a hat that can display pictures of various shapes and sizes.

In accordance with the illustrative embodiments, demonstrating features and advantages of the present invention, there is provided a picture cap that can removably house a picture or the like and visually display the same. The picture cap includes a head covering portion with a window opening formed therein. The head covering portion has an inside surface and an outside surface. A picture retaining pocket is secured to the inside surface of the head covering portion. The picture retaining pocket has a bottom end, inner and outer walls that extend upwardly from the bottom end and an open top end. The bottom end and the walls provide a space therebetween. The outer wall of the pocket extends around the periphery of the window opening and is comprised of a transparent material so that a picture inserted between the walls can be visually displayed.

Other objects, features and advantages will be readily apparent from the following detailed description of a preferred embodiment thereof taken in conjunction with the drawings.

BRIEF DESCRIPTION OF THE DRAWINGS

For the purpose of illustrating the invention, there is shown in the accompanying drawings one form which is presently preferred; it being understood that the invention is not intended to be limited to the precise arrangements and instrumentalities shown.

DETAILED DESCRIPTION OF THE PREFERRED EMBODIMENT

Figure 1:
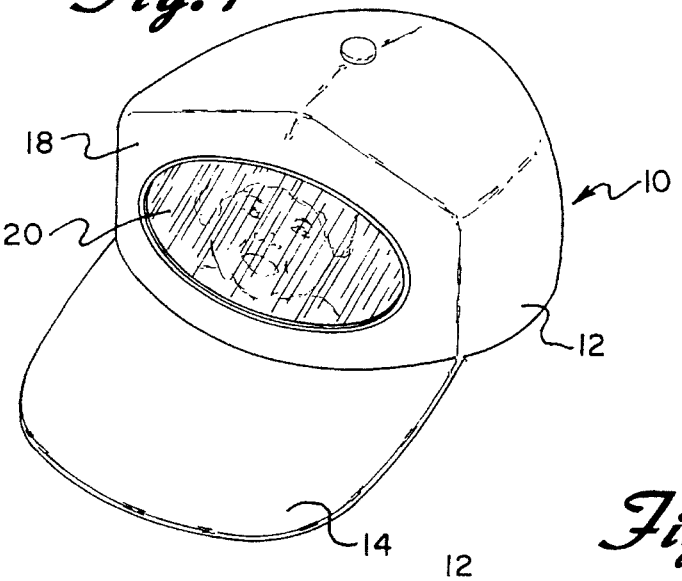
FIG. 1 is a perspective view of a picture hat constructed in accordance with the principles of the present invention.

Referring now to the drawings in detail wherein like reference numerals have been used throughout the various figures to designate like elements, there is shown in FIG. 1 a cap with a retaining pocket constructed in accordance with the principles of the present invention and designated generally as 10. While the invention is described with regards to use with a hat, it should be noted that the invention can be adapted for visually displaying pictures on other wearing apparel such as a shirt or a pair of pants. Also, the invention can be adapted for use on other items such as lunch boxes and the like.

Figure 2:
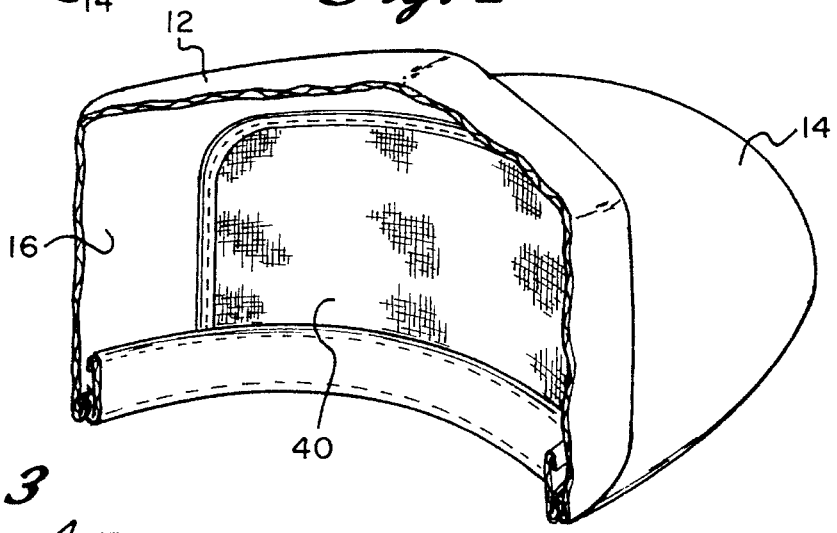
FIG. 2 is a rear, partial cross-sectional view of the picture hat.
Figure 3:
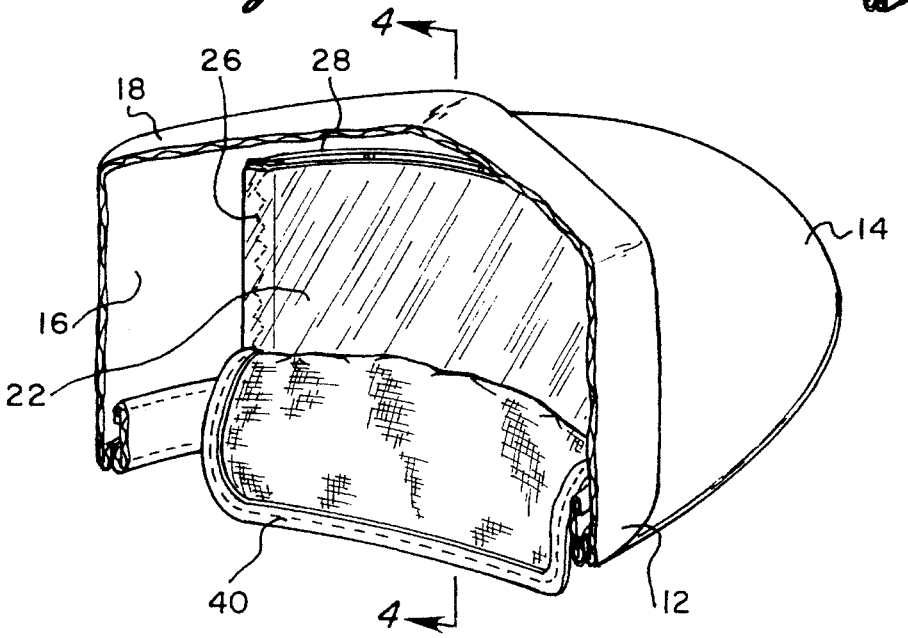
FIG. 3 is a view similar to FIG. 2 showing the protective flap folded downward.
Figure 4:
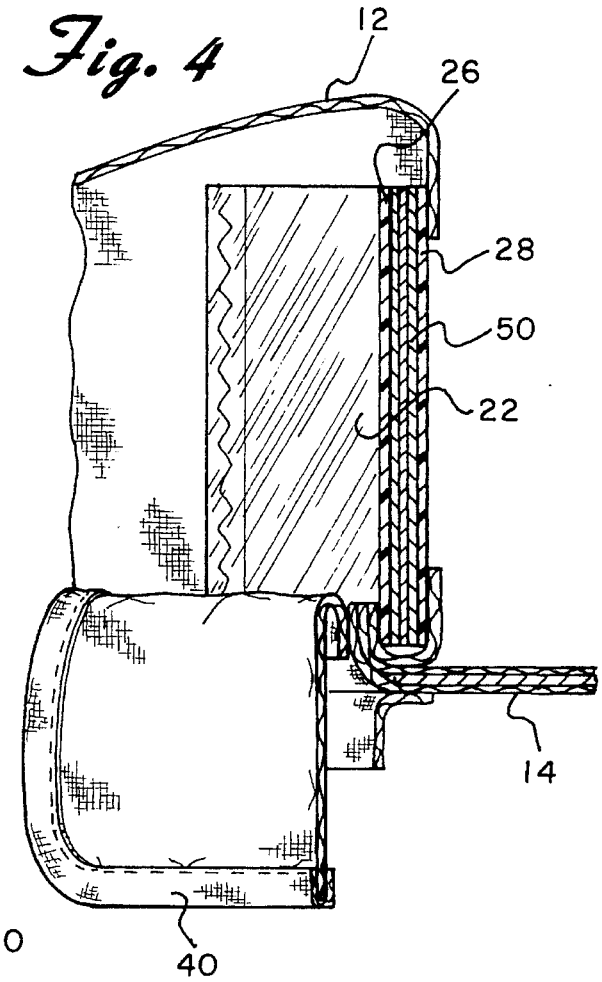
FIG. 4 is partial cross-sectional view taken along lines 4—4 of FIG. 3.

Referring to FIGS. 1–3, the cap 10 preferably includes a head covering portion or crown 12 and a brim 14 extending therefrom. The cap 10 is preferably a conventional baseball type cap with a generally circular head covering portion and brim. However, any type of cap, visor or hat can be utilized without departing from the principles set forth herein.

The head covering portion 12 has an inside surface 16 and an outside surface 18. A window opening 20 is formed in the head covering portion 12. In the preferred embodiment the window opening is oval shaped. However, the window opening 20 can be various other shapes such as rectangular, round or heart shaped.

Figure 5:
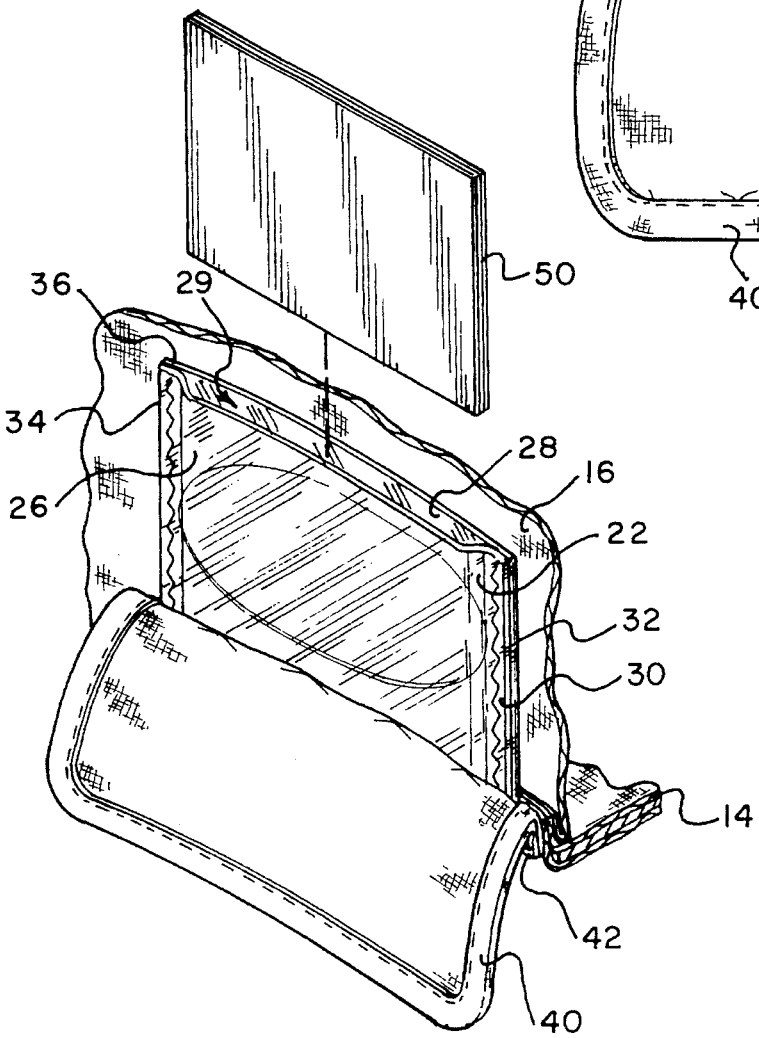
FIG. 5 is a partial cross-sectional view showing a picture removed from the picture retaining pocket.

A picture retaining pocket 22 is secured to the inside surface 16 in the manner described below. The retaining pocket 22 has a bottom end, inner and outer walls 26 and 28, respectively, and an open top end 29 as best seen in FIG. 5. The outer wall 28 of the pocket 22 extends around the periphery of the window opening 20. The inner and outer walls 26 and 28 each have a first side edge 30 and 32, respectively, and a second side edge 34 and 36, respectively. The first side edges 30 and 32 are joined to one another and to the inside surface 16 in any convenient manner such as by gluing or sewing the same. The second side edges 34 and 36 are joined in a similar manner. The inner and outer walls 26 and 28 are preferably comprised of transparent plastic. Although, it is only necessary for the outer wall 28 to be made of a transparent material.

The picture cap 10 also includes a foldable protective flap 40 that has its bottom edge 42 secured to the inside surface 16 of the head covering portion 12 adjacent the bottom end of the retaining pocket 22. The flap 40 is adapted to cover the inner wall 26 of the retaining pocket 22. The protective flap 40 serves as a barrier between the picture retaining pocket 22 and the wearer's head in order to protect the former from excessive wear caused by perspiration and the like.

In use, the wearer of the cap selects a photograph, picture or the like to be visually displayed. The protective flap 40 is then lowered to expose the picture retaining pocket 22. Next, the wearer inserts the picture 50 down into the open top end 29 of the picture retaining pocket 22 as illustrated in FIG. 5. The thickness of the space between the inner and outer walls 26 and 28, respectively, is preferably large enough to accommodate more than one picture 50. Accordingly, the wearer can store several pictures in the hat 10 at one time. Once the picture or pictures 50 are in place, the protective flap 40 is raised to cover the inner wall 26 of the picture retaining pocket 22.

The present invention may be embodied in other specific forms without departing from the spirit or essential attributes thereof accordingly reference should be made to the appended claims rather than to the foregoing specification as indicating the scope of the invention.

I claim:

1. A picture cap for retaining a picture or the like and visually displaying the same comprising:

a head covering portion having a window opening formed therein and having an inside surface and an outside surface;

a picture retaining pocket being secured to said inside surface of said head covering portion, said picture retaining pocket having a bottom end, inner and outer walls extending upwardly from said bottom end and an open top end, said bottom end and said walls providing a space therebetween, said outer wall of said pocket extending around the periphery of said window opening and being comprised of a transparent material, and a foldable protective flap having one end secured to said inside surface of said head covering portion, said flap being adapted to cover said inner wall of said retaining pocket.

2. The picture cap of claim 1 wherein said end of said foldable flap is secured adjacent said bottom end of said retaining pocket.

3. The picture cap of claim 1 wherein said inner and outer walls of said retaining pocket each have first and second side edges, said first edges on said inner and outer walls being secured to one another and said second edges on said inner and outer walls being similarly secured to one another.

4. The picture cap of claim 3 wherein said window opening is essentially oval in shape.

5. The picture cap of claim 1 wherein said space is of sufficient size to retain more than one picture at a time.

6. An improvement in a conventional baseball cap of the type including a generally circular crown having an inside surface and an outside surface and a brim wherein the improvement comprises:

said circular crown having a window opening formed therein;

a picture retaining pocket being secured to said inside surface of said crown, said picture retaining pocket having a bottom end, inner and outer walls extending upwardly from said bottom end and an open top end, said bottom end and said walls providing a space therebetween, said outer wall of said pocket extending around the periphery of said window opening and being comprised of a transparent material, and a protective flap having one end secured to said inside surface of said crown, said flap being adapted to cover said inner wall of said retaining pocket.

* * * * *